US007530833B1

(12) United States Patent
Yang

(10) Patent No.: US 7,530,833 B1
(45) Date of Patent: May 12, 2009

(54) ENERGY SAVING LAMP HOLDER

(75) Inventor: Wen Ho Yang, Taipei County (TW)

(73) Assignee: Sun-Lite Sockets Industry Inc. (TW)

( * ) Notice: Subject to any disclaimer, the term of this patent is extended or adjusted under 35 U.S.C. 154(b) by 6 days.

(21) Appl. No.: 12/000,812

(22) Filed: Dec. 18, 2007

(51) Int. Cl.
*H01R 4/50* (2006.01)

(52) U.S. Cl. ..... 439/337

(58) Field of Classification Search ..... 439/336, 439/337, 239, 241, 226, 617, 232; 313/318.01; 362/382

See application file for complete search history.

(56) References Cited

U.S. PATENT DOCUMENTS 2,372,051 A * 3/1945 Beal ..... 439/337
2,571,881 A * 10/1951 Howard ..... 439/337
5,422,487 A * 6/1995 Sauska et al. ..... 250/436
5,542,857 A * 8/1996 Hume et al. ..... 439/337
7,232,242 B2 * 6/2007 Isoda et al. ..... 362/429
7,354,175 B2 * 4/2008 Culbert et al. ..... 362/263
7,402,061 B1 * 7/2008 Tseng ..... 439/236

* cited by examiner

*Primary Examiner*—Alexander Gilman
(74) *Attorney, Agent, or Firm*—Bacon & Thomas, PLLC

(57) ABSTRACT

The present invention is to provide an energy saving lamp holder, structurally comprising a body, a set of conducting spring leaves, a set of elastic articles, an anti-backspin guide plate and a positioning plate. When installing an energy saving bulb by inserting the conducting terminals of the bulb in the positioning grooves of the positioning plate for a twist, the anti-backspin guide plate is pressed to move inward and back soon. The anti-backspin guide plate and the contact plate of the conducting spring leaf jointly seize the conducting terminals and refrains the bulb from being back spinning. The energy saving lamp holder disables electric conduction before the completion of the installation of a bulb, which further ensures no possibility of careless electric shock.

1 Claim, 5 Drawing Sheets

ENERGY SAVING LAMP HOLDER

BACKGROUND OF THE INVENTION

1. Field of the Invention

The present invention relates generally to energy saving lamp holders, and relates more particularly to an energy saving lamp holder which is in electric conduction only the whole installation is done, capable of generating anti-backspin blockage, to prevent the installation from possible electric shock and the danger for the bulb to be in backspin.

2. Description of the Prior Art

A conventional lamp holder always accompanies the bulb to be installed in it. Therefore, a variety of structures of lamp holders arise for all kinds of demands which are large in diversity. A prior art energy saving lamp holder 1, shown in FIGS. 1-3, comprises a body 11, a conducting spring leaf 12, an elastic article 13 and a positioning plate 14, where the body 11 shaped like a saucer is directly fastened to the spot during installation (for instance: the ceiling). A load cylinder 111 formed in the center of the body includes a set (two pieces) of conducting spring leaves 12 which are symmetrical in position and are connected to the opposite poles of power supply respectively. The conducting spring leaves 12 each has at its back an elastic article 13 which exerts force on the leaf once it is being pressed. Near to the top of the load cylinder 111, the positioning plate 14 is being laid and fastened, where the positioning plate 14 has at its surface a pair of symmetrical positioning grooves 141. Each of the positioning grooves 141 is further made up of a big hole 1411 and a connected thin arc groove 1412. And each of the positioning grooves 141 is connected to one of the conducting spring leaves 12. During the installation of an energy saving bulb, two conducting terminals 16 of the bulb are aimed to inserting into the big holes 1411 of the positioning grooves 141, followed by a twist along the thin arc groove 1412 for a degree until moving to a lodging point 121 on the conducting spring leaves 12 (shown in FIG. 3). At this moment, the conducting terminals 16 each presses the corresponding conducting spring leaf 12 into a slight bend, which further presses the elastic article 13 at its back. The conducting terminals 16 each is seized by a protruded structure which includes the bulges near the lodging point 121, preventing the conducting terminals 16 from back spinning (turning back). Accordingly, the conducting terminals 16 will be electrically connected to the poles of the power supply through the medium of the conducting spring leaves 12, to light the energy saving bulb.

The foregoing prior art energy saving lamp holders are in serious possibility of danger during the installation of an energy saving bulb, which take place as an installer inserted the conducting terminals 16 of an energy saving bulb into the big holes 1411 of the positioning grooves 141, followed by a twist along the thin arc groove 1412 to a position ahead of the right lodging point 121. At this moment, the conducting terminals 16 already conducted electrically with the corresponding conducting spring leaves 12 and the energy saving bulb is lighted; therefore, there could be some possibilities of danger as follows:

1. Since the circuit has been conducted to light the bulb at the moment, those who are not familiar with the installation procedure may mistake the action for completion and fail to proceed with the next. The situation looks good in the beginning (turning on and turning off are normal). Since the corresponding conducting spring leaves 12 are bent and the elastic articles 13 are compressed, both are in a position with potential energy for engaging a counteraction. Moreover, vibrations arising from uses and thermal effects will push the conducting terminals 16 spinning back from the corresponding conducting spring leaves 12. Once the conducting terminals 16 spin back to the position of the big holes 1411, the energy saving bulb is easy to come off and fall down to ground. The loss could be light as just breaking the bulb that frightens people or serious as hurting people or destroying articles, which means a potential for serious danger.
2. For those who are familiar with the installation will keep on spinning the bulb. Since the whole system is electrically conducted, an installer could be hurt for any careless uses with his tools or articles to touch the positioning grooves 141 during spinning. It is dangerous since an electric shock could be happened before the installer can complete the installation of the bulb.
3. Even if the installation is well done in locating the conducting terminals 16 exactly in the lodging points 121, the conducting terminals 16 could still come off from the lodging points 121 after a long time use under various vibrations and thermal effects because the protruded structure near the lodging point 121 are tiny bulges, which the conducting terminals 16 of the energy saving bulb as times go by will gradually spin back to the position of the big holes 1411, the energy saving bulb is then easy to come off same as in item 1. This situation is also far from safety.

Therefore, the most serious drawback during the use for the foregoing prior art energy saving lamp holders lies in the electric conduction in the circuit network happened before the installation is completed, which enables a danger of electric shock. The fact is that there is no apparatus set for the prevention of the backspin for the energy saving bulb in the structure of the energy saving lamp holders, and the mentioned drawbacks are thus formed.

Accordingly, the inventor recognized the foregoing described drawbacks and proceeded with further research and improvement, through considerable endeavor and tests, the present invention is eventually accomplished.

SUMMARY OF THE INVENTION

The objective of the present invention is to provide an energy saving lamp holder, which is capable of preventing electric shock from the installation of an energy saving bulb, and preventing the backspin of the energy saving bulb.

To achieve the foregoing objective, the present invention creates an energy saving lamp holder which comprises: a body, saucer-shaped, having a load cylinder at its center and having loaded with a central vessel and a pair of catch troughs, where the load cylinder has a set of deep side cavities; a set of conducting spring leaves, each of which is made of a slice with several folds to form a transverse contact plate, where the conducting spring leaves are located and fastened to the internal of the load cylinder, and both ends of the contact plate are fixed in the catch troughs respectively, where the conducting spring leaves are electrically connected to the poles of power supply external to the lamp holder body; a set of elastic article, fastened to the back of the contact plate, having one end fixed in the corresponding catch trough, featuring to restore the contact plate after the exerting force disappears; an anti-backspin guide plate, lump in shape inside the load cylinder, having slanting walls positioned corresponding to the foregoing conducting spring leaves, and each keeping a distance with the corresponding conducting spring leaf during assembly, forming a downward housing in the middle of its bottom side, for accommodating an elastic element, where the other end is inserted into the central vessel of the body, and the sides of the plate form lodging necks capable of inserting into the side cavities and having pushing chunks at its ends; and a positioning plate, a circular plate fixed in the load cylinder and positioned at its opening, and flanges formed on its rim, which can fit in the side cavities of the load cylinder. The positioning plate has a set of positioning grooves, where each again is divided into a big hole and a connected thin arc groove. The big hole is for the insertion of the conducting terminals of the energy saving lamp and proceed to spin through the thin arc groove.

When installing the energy saving bulb, the conducting terminals will press the anti-backspin guide plate which in turn compresses the elastic article to approach the slanting wall, and further passes the slanting wall to touch the contact plate for enabling electric conduction. The anti-backspin guide plate will be counteracted by the elastic article to move back, and seizes the conducting terminals by jointing with the contact plate, to refrain the conducting terminals from back spinning. When demounting the energy saving bulb, it is to press the pushing chunks to move the anti-backspin guide plate and the lodging neck inward, followed by turning the energy saving bulb to make its conducting terminals spin through the thin arc groove to the big hole, where the conducting terminals exit from the state of being seized, back to the top side of the anti-backspin guide plate, and ready for dismounting.

DETAILED DESCRIPTION OF THE INVENTION

To achieve the foregoing objective of the present invention, the techniques adopted and the achievable function are detailed described with reference to the following preferred example and the accompanying drawings, which is expected to help the honorable Examiner in comprehending the contents of present invention thoroughly.

Figure 4:
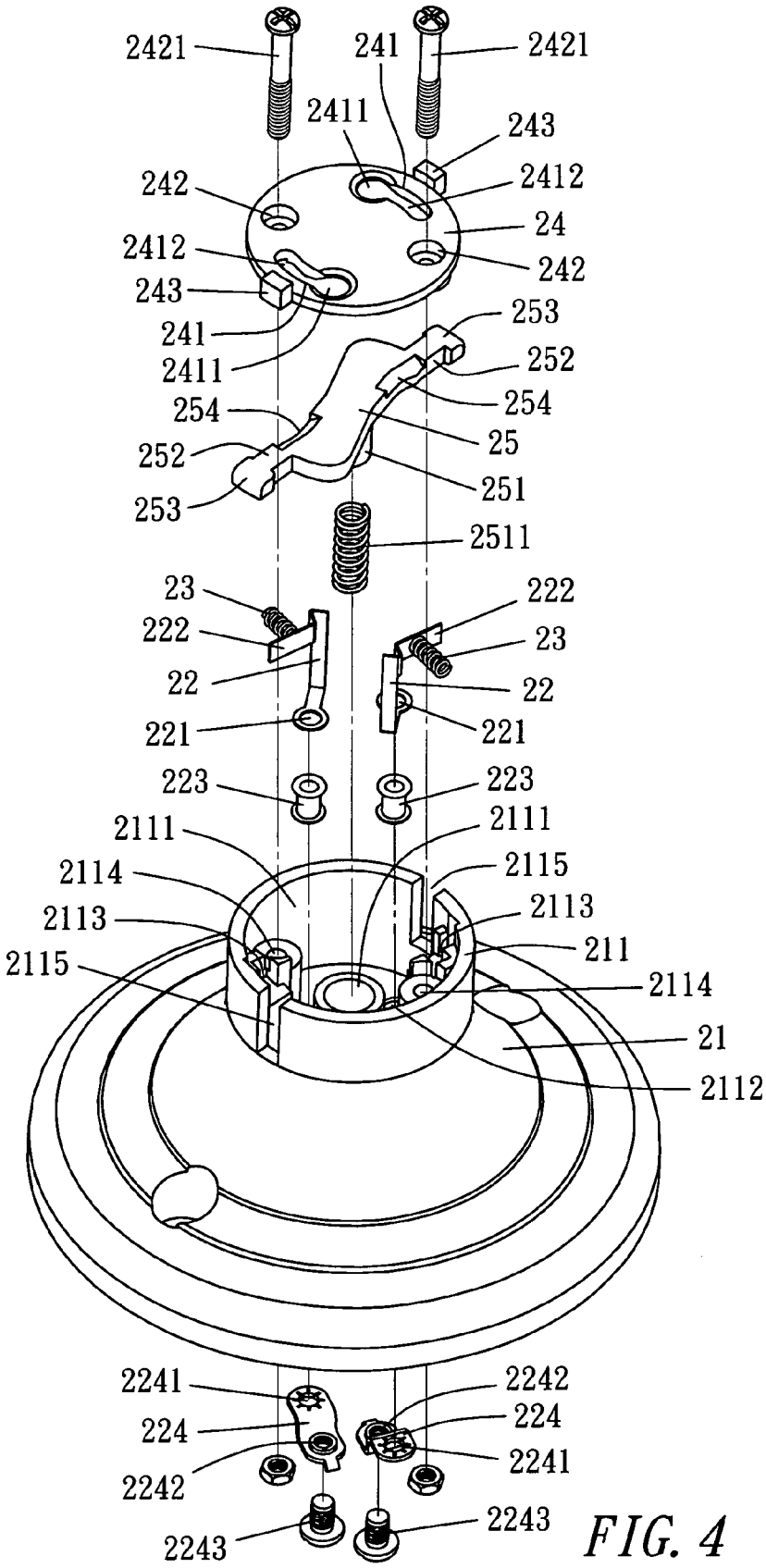
FIG. 4 is a three-dimensional exploded view showing the example of the present invention.
Figure 5:
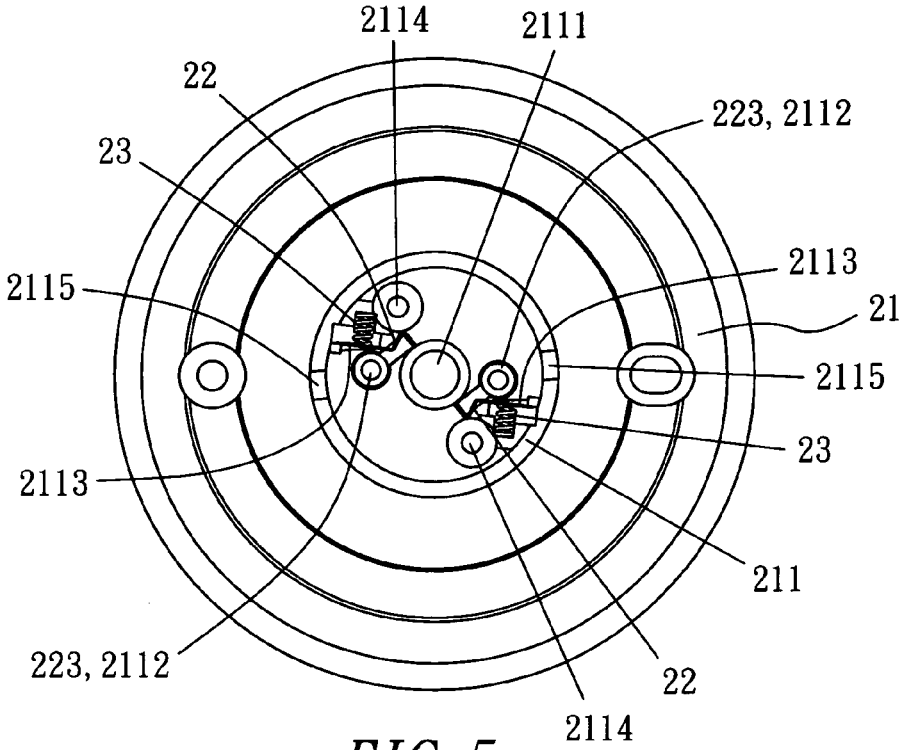
FIG. 5 is a top view showing non-assembly of the anti-backspin guide plate and the positioning plate of the example of the present invention.
Figure 6:
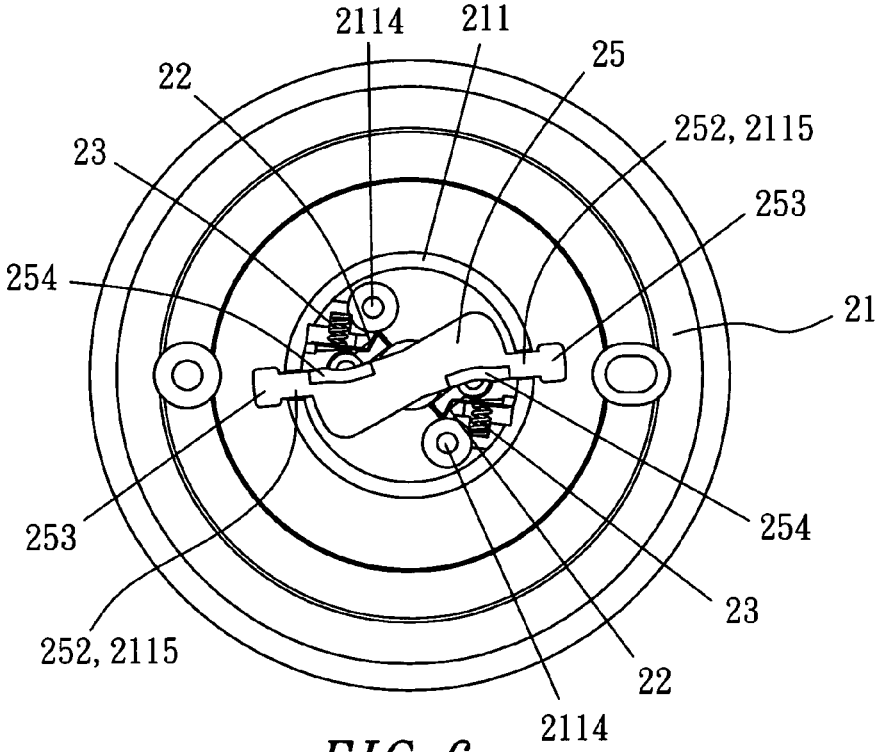
FIG. 6 is a top view showing non-assembly of the positioning plate of the example of the present invention.

Please referring to FIGS. 4-5, the example of present invention is an energy saving lamp holder 2 which comprises:

a body 21, in the shape of a saucer (having piercing holes thereon), is directly fastened (threaded) to the spot during installation (for instance: the ceiling), having a load cylinder 211 at its center, where the load cylinder 211 embraces a central vessel 2111, a set of symmetric piercing holes 2112, a set of symmetric catch troughs 2113, a set of symmetric linking vessels 2114, and a set of deep and symmetric side cavities 2115 opened on the load cylinder 211;

a set of conducting spring leaves 22, which are conducting elements made of a slice with several folds, each has an end hole 221, and a transverse contact plate 222 made by a couple of folds. The conducting spring leaf 22 is put inside the load cylinder 211 once in assembly, having its end holes 221 each pointed to a piercing hole 2112, by means of a fastener 223 (for instance: a rivet) for penetrating through the end hole 221 and the piercing hole 2112, and for penetrating into a joint hole 2241 at one end of a joiner 224 which is located at the bottom of the body 21, followed by a joint (for instance: a rivet joint), such that the conducting spring leaves 22 has its end hole 221 standing on the piercing hole 2112, through the help of the fastener 223 to electrically connect the conducting spring leaf 22 and corresponding joiner 224. The joiner 224 has its another end bent down into a step shape, on which a threaded hole 2242 is set up, for lodging each of the bolts 2243 to wire to a pole of power supply and to be screwed to the corresponding threaded hole 2242, and conducting to the joiner 224 and further to the contact plate 222 of the conducting spring leaf 22. The terminals of the contact plate 222 of the conducting spring leaf 22 are put into the corresponding catch troughs 2113 respectively for a lodging (shown in FIGS. 5-6);

a set of elastic article 23, suggested selecting a bar-typed spring, where its one end is fastened to the center of the back of the contact plate 222, and another end is fixed in the corresponding catch trough 2113 for a lodging (shown in FIGS. 5-6). Once the contact plate 222 is pressed by an external force to be bent, the elastic article 23 at its back is also being compressed. Through the elastic stretch of the elastic article 23, the contact plate 222 is restoring soon after the external force disappears;

a positioning plate 24, a circular plate that covers the opening of the load cylinder 211, having a flange 243 formed symmetrically on each of two sides along the rim, and a set of symmetrical positioning grooves 241 and a set of perforated holes 242 are opened on the circular plate, where each positioning groove 241 is divided into a big hole 2411 and a connected thin arc groove 2412; and an anti-backspin guide plate 25, lump in shape, having a downward housing 251 in the middle of its bottom side, for accommodating an elastic element 2511 (suggested selecting a bar-typed spring), and both ends are presenting symmetry in structure, where each end comprises a lodging neck 252, a pushing chunk 253 and a slanting wall built in at each side.

When in assembly, the terminals of the conducting spring leaves 22 and the contact plates 222 are put in the corresponding catch troughs 2113, with their end holes 221 pointing to the piercing holes 2112 respectively, where the fastener 223 is taken for penetrating through the above holes and fixing with the joiner 224, and the bottom of the elastic article 23 is fixed in the catch trough 2113 (shown in FIG. 5); an elastic element 2511 is then put in the central vessel 2111, followed by pointing the housing 251 of the anti-backspin guide plate 25 at the elastic element 2511 and followed by covering it, and pointing the lodging necks on both sides of the anti-backspin guide plate 25 at side cavities 2115 respectively and followed by a lodging. By means of the elastic force of the elastic element 2511, the anti-backspin guide plate 25 can be pressed to move up and down in the load cylinder 211, but since both of the lodging necks 252 are seized respectively in the side cavities 2115, which disables the movement of rotation. The slanting walls 254 each is near a contact plate 222, but a distance is kept in between (shown in FIG. 6). The positioning plate 24 is then taken to cover the opening of the load cylinder 211 (its bottom is pressing on the anti-backspin guide plate 25), and the flanges 243 of both sides are forced to push against the entrances of the side cavities 2115 and the lodging necks 252 of the anti-backspin guide plate 25 simultaneously (shown in FIG. 7). A fastener 2421 (for example: a bolt) is taken to penetrate through the perforated hole 242 to join (screw joint) with the link vessel 2114 of the load cylinder 211, to stabilize the positioning plate 24.

Figure 1:
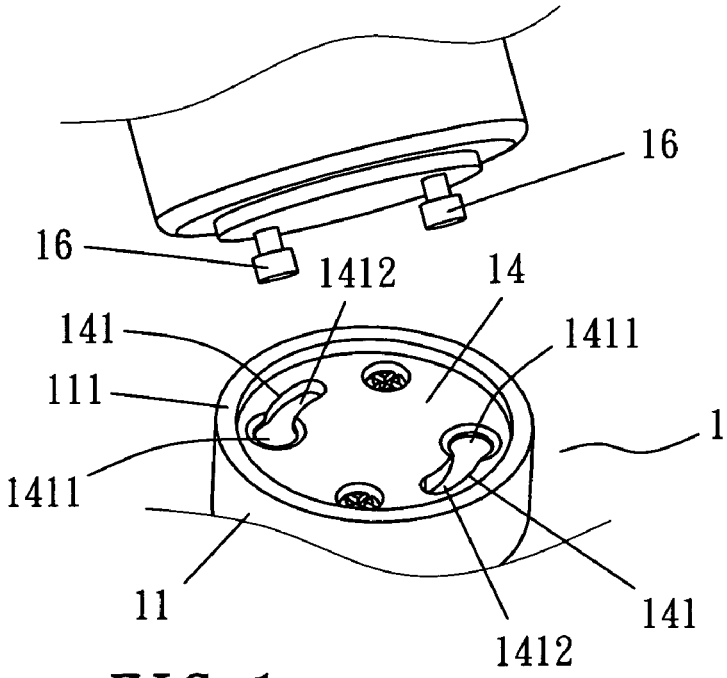
FIG. 1 (PRIOR ART)
FIG. 1 is a three-dimensional partly exploded schematic illustration showing the usage of a prior art example.
Figure 9:
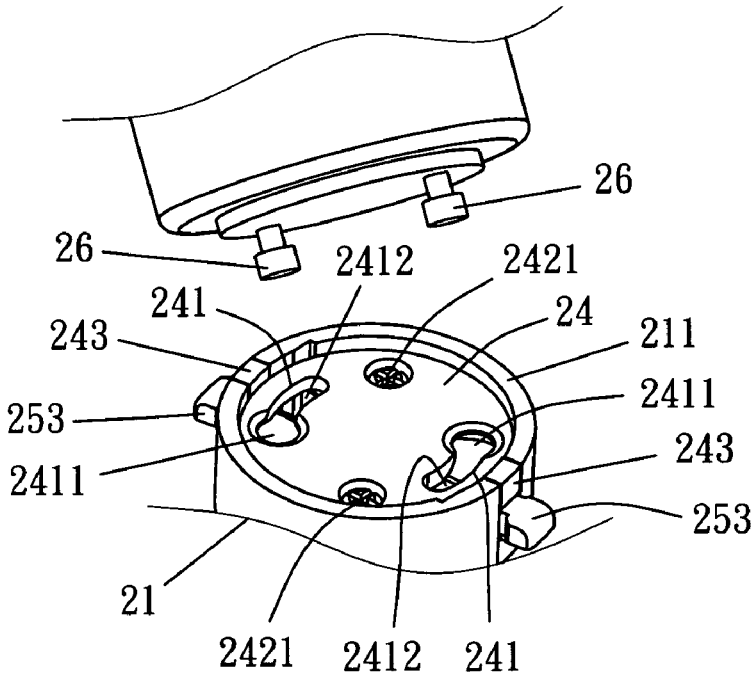
FIG. 9 is a three-dimensional partly exploded schematic illustration showing the usage of the example of the present invention.
Figure 2:
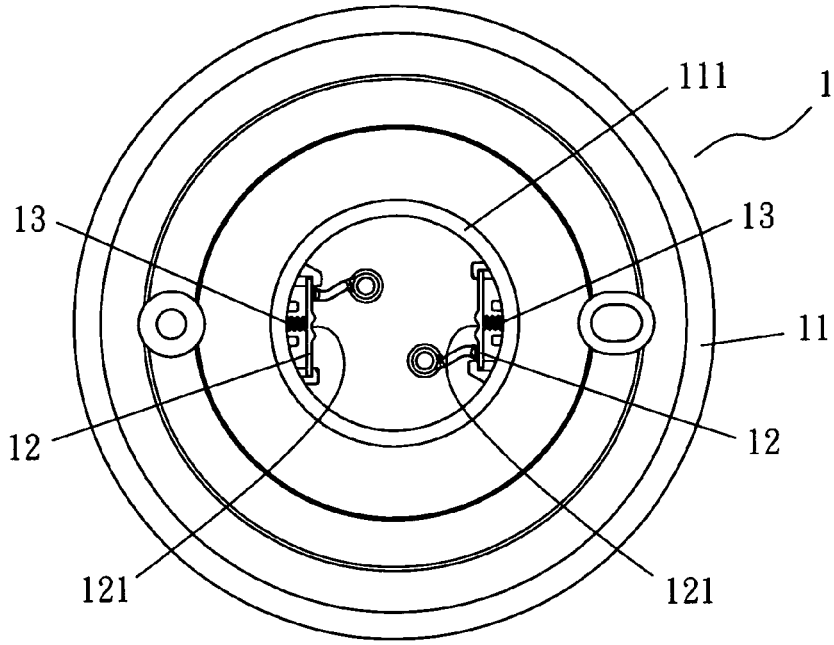
FIG. 2 (PRIOR ART)
FIG. 2 shows a top view of non-assembly of the positioning plate of a prior art example.
Figure 3:
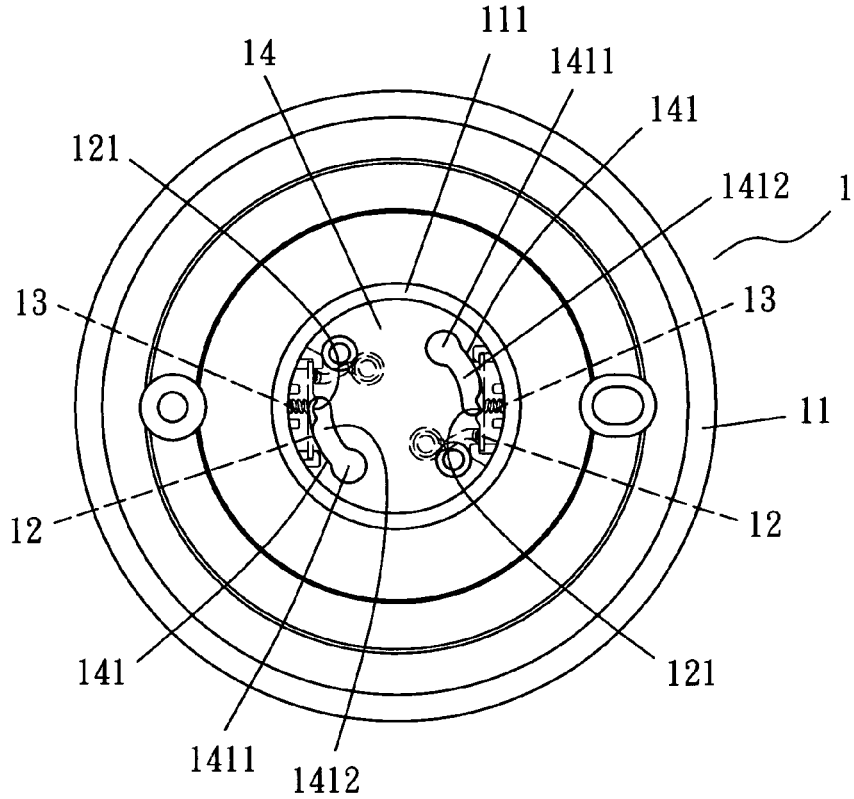
FIG. 3 (PRIOR ART)
FIG. 3 is a top view of a prior art example.
Figure 7:
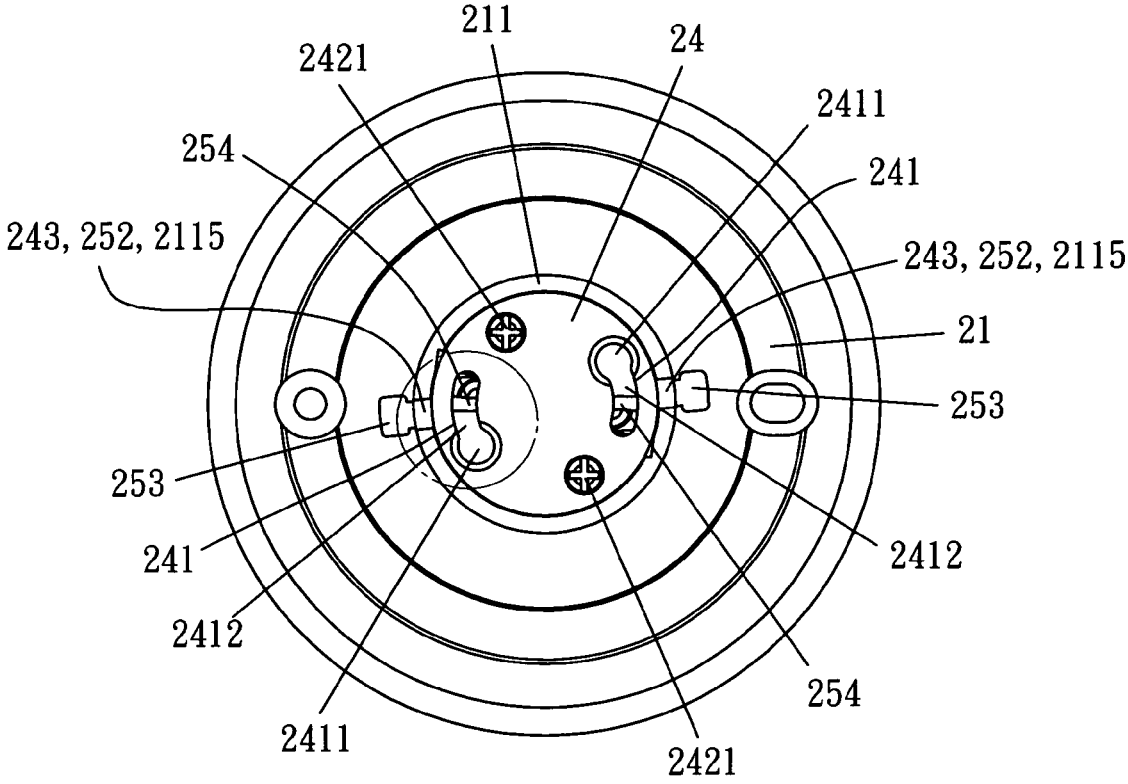
FIG. 7 is a top view of the example of the present invention.
Figure 8:
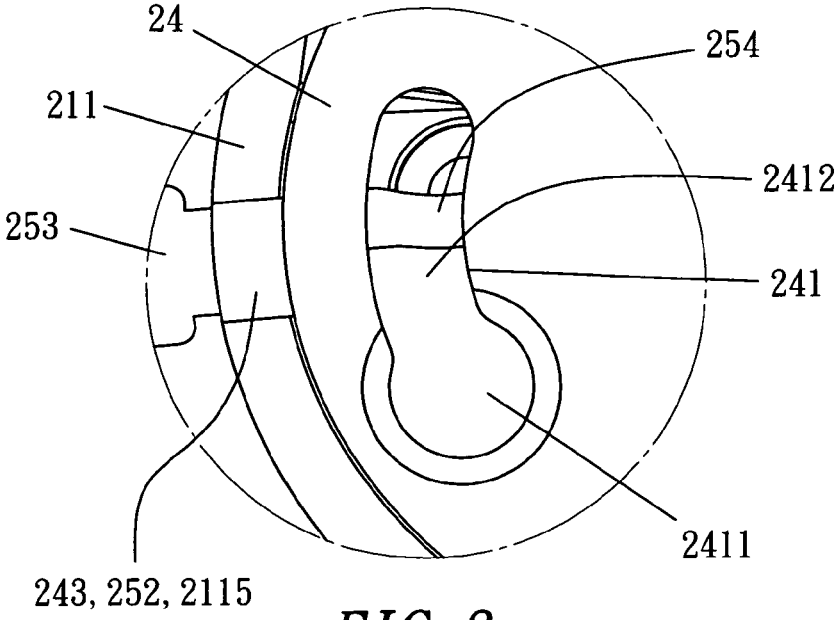
FIG. 8 is a partly enlarged view of FIG. 7.

The foregoing description is focus on the assembly of the energy saving lamp holder 2 of the example of the present invention. The forthcoming step is to fix directly the lamp holder 2 (having piercing holes for accommodating screws to be helically threaded) at the installed spot (for instance: ceiling) to be ready for the installation of energy saving bulb. Referring to FIGS. 7-9, as the energy saving lamp holder 2 of the example of the present invention is being used for lodging the energy saving bulb, the installer is holding the bulb and pointing the two conducting terminals 26 (shown in FIG. 9) at the big holes 2411 of the positioning grooves 241 respectively and followed by a inserting. The conducting terminals 26 will touch first the top surface of the anti-backspin guide plate 25, with a push and a twist on the energy saving bulb, which is to have its conducting terminals 26 pressing the anti-backspin guide plate 25 inward (hence compressing the elastic element 2511 to be stretched). In the other respect, spinning along the thin arc groove 2412, the conducting terminals 26 arrive at the slanting walls 254 shortly, and with the push and spin simultaneously, the conducting terminals 26 soon move through the slanting walls 254 and across the anti-backspin guide plate 25 (the conducting terminals 26 rotate to depart from the top side of the anti-backspin guide plate 25). To this point, the conducting terminals 26 have touched the contact plate 222 and electrically conducted. Since the anti-backspin guide plate 25 is free of a push, and the elastic element 2511 provides restoring force. The conducting terminals 26 thus will be seized by the contact plate 222 and the anti-backspin guide plate 25, and the contact plate 222 will be a bit bent subject to the pressing of the conducting terminals 26, and the pressing is balanced by the elastic article 23 at its back. Due to the conducting terminals 26 being firmly seized, there is no possibility to spin back, which avoids the danger of suddenly being dropped off during uses as in the prior art examples. Moreover, before the conducting terminals 26 move across the anti-backspin guide plate 25, there is no contact to the contact plate 222; therefore, no electric conduction in the circuit before the accurate completion of installation, which absolutely abstain from the possibility of electric shock during installation.

As for dismounting the energy saving bulb from the energy saving lamp holder 2 (for instance: replace the spoiled bulb), one hand should hold the bulb while the other hand presses the pushing chunks 253 to move the lodging necks inward along the side cavities 2115. The movement makes the anti-backspin guide plate 25 moving inward to touch the tips of the conducting terminals 26. With a slight twist on the bulb, the conducting terminals 26 can be free from the seizure by the contact plate 222 and the anti-backspin guide plate 25, and move along the thin arc groove 2412 back to the big hole 2411, meanwhile, unclasping the pressing on the pushing chunks 253 (the bulb is still be held). Because the conducting terminals 26 suddenly come off from the contact with the contact plate 222, the electric conduction is ceased immediately, which refrains from the danger of electric shock. Because the tips of the conducting terminals 26 return to the top side of the anti-backspin guide plate 25, the conducting terminals 26 will be pushed to come off the big hole 2411 by the outward movement of the anti-backspin guide plate 25 which is triggered by the restore force of the elastic element 2511. At this moment, the energy saving bulb is ready to be taken off from the energy saving lamp holder 2.

From the foregoing description, the energy saving lamp holder 2 of the example of the present invention disables electric conduction before the completion of the installation of the energy saving bulb, which further makes sure no possibility of careless electric shock. It also leaves aside any misconceptions of recognition on completion of installation, which results in dangers of the backspin and suddenly falling of the bulb. Moreover, the energy saving lamp holder 2 of the present invention can completely avoid the possibility of backspin for the bulb, which completely sure of no uncertainties of danger. Therefore, the present invention has made substantial progresses in improving the drawbacks of prior art examples, and accomplished the expected objective and function.

In general, the disclosed energy saving lamp holder of the present invention has not opened to the public for its whole structure, and absolutely novel. It can completely refrain from the possibility of backspin for the bulb, and further completely sure of no uncertainties of danger, which surely accomplish the expected objective and function of the present invention. It is also construed as being compliant to the requirements for novelty and usefulness of utility patent, and an application is then filed according to the U.S. Patent Statue, which deserves your favorable examination and approval.

What is claimed is:

1. An energy saving lamp holder, comprising:

a body, in the shape of a saucer, having a load cylinder at its center, where the load cylinder embraces a central vessel and a set of catch troughs, and a set of deep side cavities opened on the load cylinder;

a set of conducting spring leaves, each made of a slice with several folds into the main of transversely resided contact plate; the conducting spring leaves being fastened inside the load cylinder, where the ends of the contact plates of the conducting spring leaves are inserted into the corresponding catch troughs respectively for a lodging; the conducting spring leaves being connected to the electric poles of power supply external to the body for the electric conduction;

a set of elastic articles, fastened to the back of the contact plates, with one end being fixed in the corresponding catch trough for a lodging; offering the contact plates, which are bent by external force, the restoration as the external force disappears;

an anti-backspin guide plate, lump in shape and located in the load cylinder, having slanting walls corresponding to the foregoing conducting spring leaves, keeping a distance with the neighboring conducting spring leaf during assembly, forming a downward housing in the middle of its bottom side, for accommodating an elastic article, where the other end of the elastic article is inserted into the central vessel of the body, and the sides of the anti-backspin guide plate forming lodging necks which are capable of being put into side cavities and having a pushing chunk at its both end; and a positioning plate, a circular plate covering on the opening of the load cylinder, and flanges formed on its rim, which can fit in the side cavities of the load cylinder, the positioning plate having a set of positioning grooves where each is divided into a big hole and a connected thin arc groove, the big hole being offering for the insertion of the conducting terminals of the energy saving bulb and spinning along the thin arc groove;

when installing the energy saving bulb, the conducting terminals pressing the anti-backspin guide plate moving inward to arrive at the slanting wall and moving across the slanting wall until touching the contact plate for the electric conduction, where the anti-backspin guide plate is counteracted by the elastic article to move back to its original place, seizing the conducting terminals by jointing with the contact plate, to refrain the conducting terminals from back spinning; during demounting the energy saving bulb, it being to press the pushing chunks to move the anti-backspin guide plate and the lodging neck inward down the side cavities, followed by turning the energy saving bulb to have its conducting terminals spinning through the thin arc groove to the big hole, where the conducting terminals are able to exit from the state of being seized, back to the top side of the anti-backspin guide plate, and the bulb being ready for dismounting.

* * * * *